US009701129B2

(12) United States Patent
Pourtier et al.

(10) Patent No.: US 9,701,129 B2
(45) Date of Patent: Jul. 11, 2017

(54) METHOD AND DEVICE FOR MAINTENANCE AND PROTECTION OF A HYDRAULIC CONNECTION

(71) Applicant: Dover Europe Sàrl, Vernier (CH)

(72) Inventors: Francis Pourtier, Charmes sur Rhone (FR); Jean-Pierre Arpin, Beaumont-Monteux (FR)

(73) Assignee: DOVER EUROPE SÀRL, Vernier (CH)

( * ) Notice: Subject to any disclaimer, the term of this patent is extended or adjusted under 35 U.S.C. 154(b) by 0 days.

(21) Appl. No.: 15/088,190

(22) Filed: Apr. 1, 2016

(65) Prior Publication Data

US 2016/0288522 A1 Oct. 6, 2016

(30) Foreign Application Priority Data

Apr. 2, 2015 (FR) ..... 15 52875
May 13, 2015 (FR) ..... 15 54355

(51) Int. Cl.
*B41J 2/18* (2006.01)
*B41J 2/175* (2006.01)
(Continued)

(52) U.S. Cl.
CPC ..... *B41J 2/17596* (2013.01); *B41J 2/18* (2013.01); *B41J 2/185* (2013.01); *B41J 2/20* (2013.01);
(Continued)

(58) Field of Classification Search
CPC ..... B41J 2/17596; B41J 2/18; B41J 2/17503; B41J 2/17566; B41J 2/20; B41J 2/185
See application file for complete search history.

(56) References Cited

U.S. PATENT DOCUMENTS 6,116,722 A * 9/2000 Sato ..... B41J 2/17506 347/85
2008/0125697 A1* 5/2008 Gao ..... A61M 1/0058 604/35
(Continued)

FOREIGN PATENT DOCUMENTS

FR 2 618 728 A1 2/1989
FR 2 954 215 A1 6/2011
WO 02/096654 A1 12/2002

OTHER PUBLICATIONS

Search Report issued in French Patent Application No. FR 15 54355 dated Dec. 1, 2015.
(Continued)

*Primary Examiner* — Manish S Shah
*Assistant Examiner* — Yaovi M Ameh
(74) *Attorney, Agent, or Firm* — Pearne & Gordon, LLP

(57) ABSTRACT

A method of cleaning an ink circuit of an inkjet printer, including at least one reservoir, called the main reservoir, at least one ink cartridge, a first pump to pump ink from the cartridge, a first fluid connection to transfer ink from the ink cartridge to the reservoir, a second pump to pump ink from the reservoir (10), a second fluid connection to transfer ink to the ink cartridge, and a controller. The method includes a) a step in which ink is transferred from the main reservoir as far as the cartridge, through the second pump and the second fluid connection, and b) a step to pump at least part of the ink transferred during step a) to the main reservoir.

20 Claims, 6 Drawing Sheets

(51) Int. Cl.
*B41J 2/185* (2006.01)
*B41J 2/20* (2006.01)

(52) U.S. Cl.
CPC ..... *B41J 2/17503* (2013.01); *B41J 2/17566* (2013.01)

(56) References Cited

U.S. PATENT DOCUMENTS

| | | | | |
|---|---|---|---|---|
| 2010/0079517 | A1 | 4/2010 | Akatsuka | |
| 2012/0299989 | A1* | 11/2012 | Prothon | B41J 2/175 347/6 |
| 2012/0327145 | A1 | 12/2012 | Pouzet | |
| 2013/0021396 | A1* | 1/2013 | Hirano | B41J 2/175 347/6 |
| 2013/0242005 | A1 | 9/2013 | Iwata | |
| 2013/0321501 | A1* | 12/2013 | Igarashi | B41J 2/175 347/7 |
| 2014/0022318 | A1* | 1/2014 | Cameno | B41J 2/17546 347/86 |
| 2016/0039216 | A1 | 2/2016 | Ribiero | |
| 2016/0052291 | A1 | 2/2016 | Pourtier | |

OTHER PUBLICATIONS

U.S. Appl. No. 14/919,156, "Device for Measuring a Level in a Tank" filed Oct. 21, 2015.
Extended European Search Report issued in Patent Application No. EP 16 16 3331 dated Sep. 26, 2016.
English Machine Translation of FR 2618728 dated Nov. 10, 2016.

* cited by examiner

METHOD AND DEVICE FOR MAINTENANCE AND PROTECTION OF A HYDRAULIC CONNECTION

TECHNICAL DOMAIN AND PRIOR ART

The invention relates to the field of printers, and particularly continuous inkjet (CIJ) type printers.

It also relates to the architecture (the layout of the Ink circuit) of a printer, for example of the CIJ type, and particularly to prevent situations in which some channels along which ink passes can become blocked during use.

Continuous inkjet (CIJ) printers are well known in the field of industrial coding and marking of miscellaneous products, for example for marking barcodes, Best Before dates on food products or references or distance marks on cables or pipes directly on the production line at high speed. This type of printer is also used in some decoration fields in which the possibilities of industrial graphic printing are used.

These printers have several typical subassemblies, as shown in FIG. 1.

Firstly, a print head 1, used usually offset from the body of the printer 3, is connected to it through a flexible umbilical 19 containing hydraulic and electrical connections necessary for operation of the head, while providing it with flexibility to facilitate integration on the production line.

The body of the printer 3 (also called the console or cabinet) usually contains three subassemblies:

- an ink circuit in the lower part of the console (zone 4'), that firstly supplies an appropriate quality of ink to the head at a stable pressure, and secondly handles ink output from jets that is not used for printing;
- a controller located in the top of the console (zone 5'), capable of managing sequences of actions and performing processing to activate different functions of the ink circuit and the head;
- an interface 6 that provides the operator with the means of using the printer and remaining informed about its operation.

In other words, the cabinet comprises 2 subassemblies: electronics, the electrical power supply and the operator interface at the top, and the ink circuit supplying nominal quality ink under pressure to the head and the negative pressure at which ink not used by the head is recovered, at the bottom.

FIG. 2 diagrammatically shows a print head 1 of a CIJ printer. It comprises a drop generator 60 supplied with electrically conducting ink pressurised by the ink circuit 4.

This generator is capable of emitting at least one continuous jet through a small dimension orifice called a nozzle. The jet is transformed into a regular succession of identically sized drops under the action of a periodic stimulation system (not shown) located upstream from the nozzle outlet. When the drops 7 are not used for printing, they are directed towards a gutter 62 that recovers them to recycle unused ink and return it into the ink circuit 4. Devices 61 placed along the jet (charge and deflection electrodes) can electrically charge the drops on command and deflect them in an electrical field Ed. They are then diverted from their natural ejection trajectory from the drop generator. The drops 9 intended for printing escape from the gutter and will be deposited on the support 8 to be printed.

This description can be applied to continuous ink jet (CIJ) printers said to be binary or multi-deflected continuous jet. Binary CIJ printers are provided with a head of which the drop generator has a large number of jets, and each drop from a jet can be oriented towards only 2 trajectories, either print or recovery. In multi-deflected continuous jet printers, each drop from a single jet (or from a few jets at intervals from each other) can be deflected on various trajectories corresponding to commands with different charges from one drop to another, thus scanning the zone to be printed along one direction called the deflection direction, the other scanning direction of the zone to be printed is covered by relative displacement of the print head and the support 8 to be printed. Elements are usually arranged such that these two directions are approximately perpendicular to each other.

An ink circuit of a continuous inkjet printer can firstly provide ink under regulated pressure, and possibly solvent, to the drop generator of the head 1 and can create a negative pressure to recover fluids returned from the head not used for printing.

It is also possible to manage consumables (distribution of ink and solvent from a reservoir) and to control and maintain the ink quality (viscosity/concentration).

Finally, other functions are related to the comfort of the user and automatic control over some maintenance operations so as to guarantee identical operation regardless of usage conditions. These functions include rinsing the head (drop generator, nozzle, gutter) with solvent, assistance with preventive maintenance such as the replacement of limited life components (filters, pumps).

These various functions have very different end purposes and technical requirements. They are activated and sequenced by the printer controller 5' that will become increasingly complex as the number and sophistication of the functions increase.

Concerning the inks used, inks containing pigments, for example titanium oxide ($TiO_2$ rutile or anatase), in the form of sub-micronic particles, are particularly useful for their whiteness and opaqueness. They are called pigment inks and are used for marking and identification of black or dark supports.

But dense pigment particles naturally tend to settle, particularly inside ink supply conduits, when the ink is at rest. The consequences of this sedimentation may be the formation of solid plugs in these conduits, that can partially or completely block them. Furthermore, during essential maintenance operations, exposing connections to air in the presence of ink can cause the formation of dry ink plugs. The same problem also arises with the connection cannula between the ink cartridge and the ink circuit; ink is supplied to the circuit from a cartridge that is a consumable element that the user replaces when it is empty. The connection to the ink circuit is made through a cannula that fits into an adapted opening in the cartridge and that will also form an ink sedimentation zone in which solid plugs can be formed.

The main result is difficulties in supplying ink and loss of opaqueness of the markings.

These problems are critical and action by a technician is necessary because ink cannot be stirred when it is in the connection ducts and means; the printer is then blocked and production is stopped, which means that the user is discontented and there is a resulting loss of time and extra costs.

In the specific field of inkjet printers, there is no known technique for solving these connection blockage problems, particularly in cannula conduits or pipes in which ink circulates, particularly from the ink cartridge to the main ink reservoir.

Therefore, the problem arises of making an ink circuit and a method of controlling an ink circuit such that hydraulic connections can be cleaned, at least between an ink cartridge and an ink circuit, particularly in the case of a pigment ink.

It is also required to find a method of performing such cleaning during the various operational or non-operational phases of an inkjet printer.

Moreover, consumables used in this type of device, and particularly the ink and solvent, are generally expensive elements.

Therefore, it is required to minimise their consumption while preventing blockage of the conduits and connections in the ink circuit.

The same problem arises for any ink, even if it is not a pigment ink, that can dry and form deposits of dry material in the conduits and connections of the ink circuit.

PRESENTATION OF THE INVENTION

The invention relates firstly to a method of cleaning an ink circuit of an inkjet printer, comprising at least:

a reservoir called the main reservoir;

at least one ink cartridge, or a removable ink cartridge, a first pump to pump ink from the cartridge, first fluid connection means to transfer ink from the ink cartridge to the reservoir, a second pump to pump ink from said reservoir, second fluid connection means to transfer ink from the reservoir to the ink cartridge, and printer control means, this method comprising at least:

a) a step in which ink is transferred from the main reservoir as far as the cartridge, through, or by, the second pump and the second fluid connection means;

b) a step to pump at least part of the ink transferred during step a) to the main reservoir, through, or by, the first pump and the first fluid connection means.

During step b), ink is pumped to the main reservoir along a path different from the path used by ink from the main reservoir, except for the common part at the inlet to the cartridge.

The first fluid connection means and second fluid connection means are different from each other; they can have a common part at the inlet to the cartridge, but they are different. In other words, they have a common part at the inlet to the cartridge and parts which are different from each other between said common part and the main reservoir.

The first pump and the second pump are different from each other.

Such a method is particularly suitable for printer shutdown phases.

According to one embodiment, the ink level in the main reservoir remains identical before step a) and after step b). For example, the method includes detection of the ink level in the main reservoir at least once before step a) and/or after step b). It is preferable to stabilise the ink level in the reservoir each time before detection of the ink level in the main reservoir.

Levels measured before step a) and/or after step b) can be compared, and ink may be added into the main reservoir if the ink level after step b) is lower than the level before step a).

Such a method may also include:

before step a), a step in which an ink quantity, preferably the ink quantity that will be used during steps a) and b) is transferred from the cartridge to the reservoir, through the first pump and the first fluid connection means;

after step b), a step in which an ink quantity is transferred from the reservoir to the cartridge, through the second pump and the second fluid connection means.

Regardless of which embodiment is envisaged, the ink circuit may advantageously comprise third fluid connection means between the first fluid connection means and the second fluid connection means, the method may then comprise an ink circulation step using the first pump, through part of the first fluid connection means, the third fluid connection means and part of the second fluid connection means.

Another cleaning cycle can thus be performed using a loop that comprises the first pump, part of the first fluid connection means, the third fluid connection means and part of the second fluid connection means. This cleaning cycle may be performed, including during the operation phase of the printer, independently of shutdown phases and performance of the method described above.

In general, step b) may be preceded by a step to pressurise at least part of the circuit between the reservoir and the cartridge to an intermediate pressure ($P_{ei}$), less than the pressure ($P_{e0}$) used during printing, and stabilisation at this intermediate pressure ($P_{ei}$).

Very advantageously, the following may be performed before step a):

detection of the presence of the ink cartridge, for example by exchange of at least one item of data, between a circuit associated with the cartridge and the printer control means;

possibly, detection of the non-empty state of the ink cartridge, for example from at least one measurement of an ink level in the main reservoir.

The invention combined with one of the methods described above, may include the following, in particular when the ink cartridge is empty:

a') a step in which solvent is transferred to the cartridge at pressure P1, through at least part of the fluid connection means between the ink cartridge and the reservoir, b') a step in which at least part of the solvent transferred to the main reservoir during step a) is pumped.

During step a'), the solvent may be transferred to the cartridge through part of the fluid connection means between the ink cartridge and the reservoir, the solvent for example flowing in the direction opposite to the ink circulation direction when it is transferred from the ink cartridge to the reservoir.

Step b') may be performed using said pump, to pump ink from said ink cartridge to the main reservoir.

Steps a') and b') may be reiterated.

Pressure P1 may be between 1 and 10 bars.

After step a'), the solvent can be kept under pressure P1, while making a measurement of the variation in the solvent pressure or the level or volume of the solvent.

The solvent pressure may be varied one or several times if a reduction in the solvent pressure or the level or volume of the solvent greater than a threshold value is not measured.

A method according to the invention may also comprise a step in which solvent is transferred into the cartridge and into at least part of the fluid connection means, without a step to pump at least part of the solvent thus transferred to the main reservoir.

According to one embodiment, a method according to the invention may comprise a step, before step a) or a'), to detect the presence of the ink cartridge, for example by exchanging at least one item of data between an electronic or electrical circuit associated with the cartridge and the printer control means.

The solvent transferred during step a') may be drawn off from part of the main reservoir. Before step a'), a step can be performed to detect the solvent level in the main reservoir.

A method according to the invention may comprise a step before step a) or a'), to detect the empty state, or the non-empty state, of the ink cartridge, for example making use of at least one measurement of an ink level in the main reservoir.

A method according to the invention may comprise a step, for example before step a) or before step a'), to detect the clogged state of at least part of the fluid connection means between the ink cartridge and the reservoir, for example by measuring the variation of the ink level in the main reservoir when pumping ink from the ink cartridge to the main reservoir.

After detection of a clogged state, solvent, transferred to the cartridge at a pressure P1, through at least part of the first fluid connection means, can be kept at pressure P1, while making a measurement of the variation in the solvent pressure or the level or volume of the solvent.

The solvent pressure may be varied one or several times if a reduction in the solvent pressure or the level or volume of the solvent greater than a threshold value is not measured.

Advantageously, the measurement of the variation in the solvent pressure or the solvent level or volume can be used to verify the effectiveness of unblocking and possibly, if it is not effective, to perform one or several iterative variations of the solvent pressure.

The invention also relates to an ink circuit of a continuous inkjet printer comprising at least one reservoir called the main reservoir, and printer control means, the printer control means being adapted or programmed to implement a method according to the invention.

The invention also relates to an ink circuit of a continuous inkjet printer, comprising:

a reservoir called the main reservoir;

a first pump to pump ink from an ink cartridge or from ink cartridge connection means, and first fluid connection means to transfer ink from an ink cartridge to the reservoir, a second pump to pump ink from said reservoir, second fluid connection means to transfer ink from the reservoir to an ink cartridge or to ink cartridge connection means (or means used to connect an ink cartridge), and printer control means, these means being designed to:

a) transfer ink from the main reservoir to a cartridge or cartridge connection means, through the second pump and through the second fluid connection means, b) pump at least some of the ink transferred in step a) to the main reservoir, through the first pump, and through the first fluid connection means.

The control means can be used to pump at least some of the ink transferred in step a) to the main reservoir, through the first pump and through the first fluid connection means, along a path different from the path followed by ink transferred from the main reservoir to the cartridge or the connection means of a cartridge, except for the common part comprising the ink cartridge connection means.

The first fluid connection means and the second fluid connection means are different from each other; they may have a common part at the inlet to a cartridge or ink cartridge connection means, but they are different. In other words, they have a common part at the inlet to the cartridge, or of the ink cartridge connection means, and parts which are different from each other between said common part and the main reservoir. The first pump and the second pump are different from each other.

Regardless of the envisaged embodiment, the ink circuit can advantageously comprise third fluid connection means between the first fluid connection means and the second fluid connection means. Means, for example one or several valves, can then be used to make a fluid circulation circuit comprising the first pump, part of the first fluid connection means, third fluid connection means, and part of the second fluid connection means.

The printer control means may also be designed to:

a') send solvent at a pressure P1, to said means of connecting an ink cartridge to the device, through at least part of said fluid connection means, b') pump at least part of a solvent, present in said means to connect an ink cartridge to the device and in at least part of said fluid connection means.

Said fluid connection means may be connected to means of injecting a solvent into them.

An ink circuit according to the invention may comprise means of measuring an ink level in the main reservoir, said printer control means being capable of calculating a residual ink level in an ink cartridge connected to the fluid connection means.

The invention also relates to an inkjet printer, comprising:

an ink circuit according to the invention, a print head, hydraulic connection means to bring ink to be printed to the print head from the ink reservoir and to transfer ink to be recovered from the print head to said ink circuit;

electrical connection means to electrically power said print head.

The inkjet printer used in a method according to the invention or in a device according to the invention may be a continuous inkjet (CIJ) printer, particularly of the binary type, or a multi-deflected continuous inkjet printer.

DETAILED DESCRIPTION OF ONE EMBODIMENT

Figure 1:
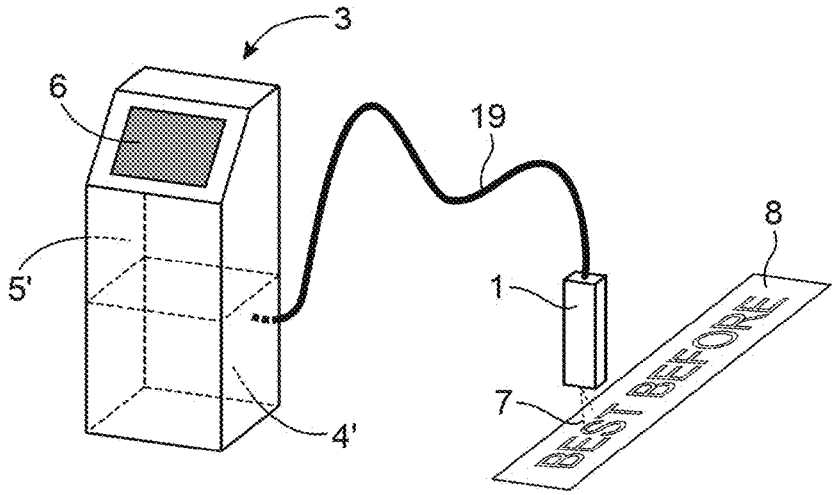
FIG. 1 shows a known printer structure.
Figure 2:
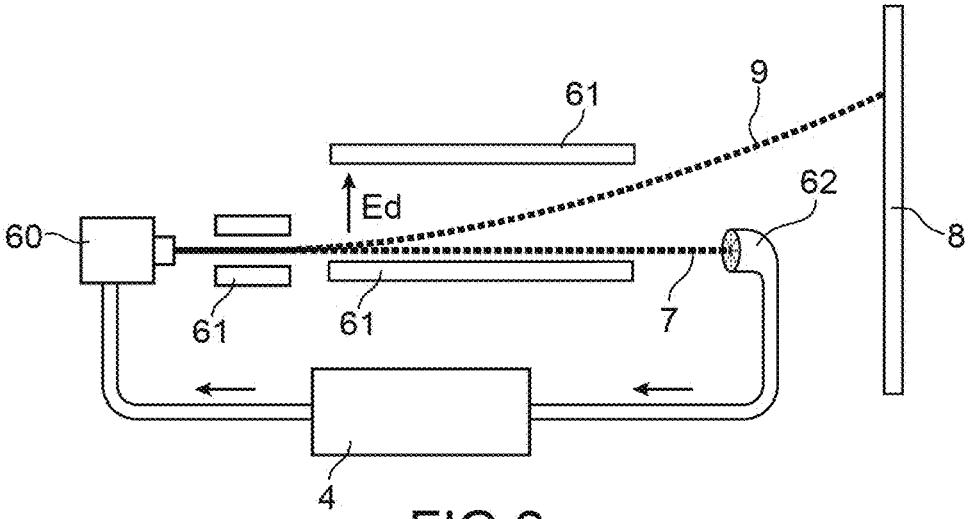
FIG. 2 shows a known structure of a print head of a CIJ type printer.
Figure 3:
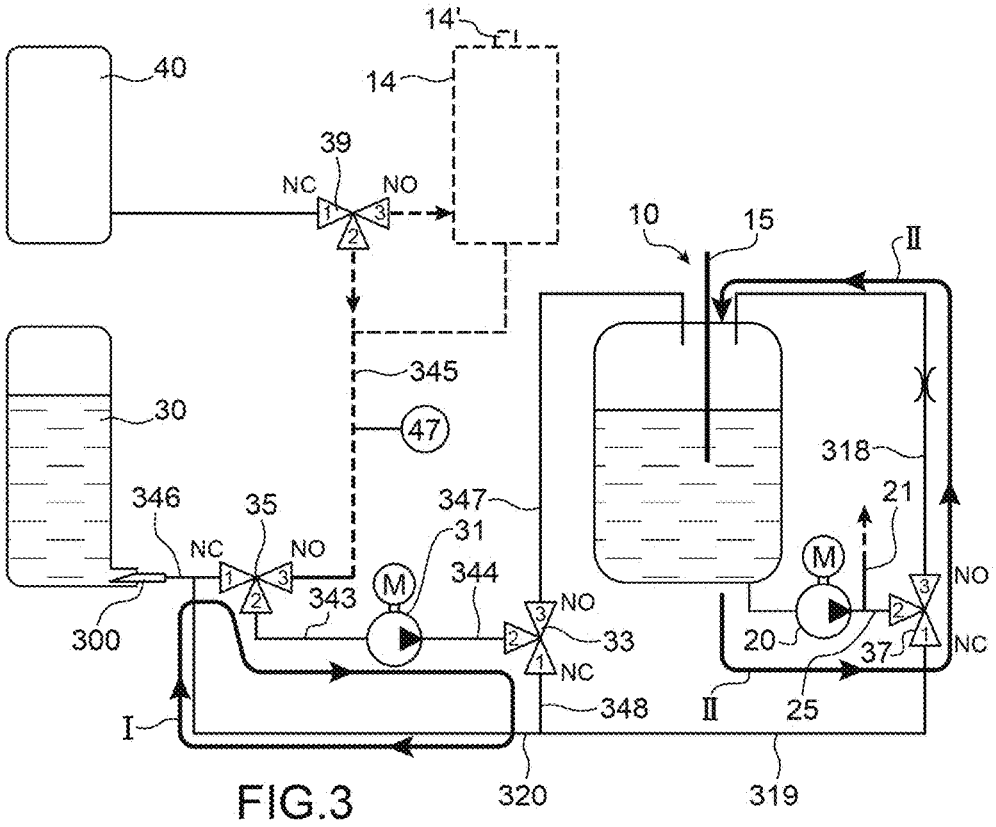
FIG. 3 is an example of a fluid circuit according to this invention.

FIG. 3 shows a removable ink cartridge 30 and an example of part of an ink circuit of the machine between the cartridge 30 and the main reservoir 10, to collect a mix of solvent and ink, and a solvent cartridge 40 that is also removable. The ink circuit may not have cartridges 30, 40 when at rest.

The main reservoir 10 is provided with means 15 for detecting the level of ink contained in it (in fact the ink in it is mixed with the solvent).

Reference 300 refers to the cannula (or any equivalent means), that will provide fluid connection between the cartridge 30 and the rest of the circuit.

When the cartridge 30 is in position and contains ink, ink may be pumped by pumping means 31 towards the main reservoir 10 through fluid connection means, comprising conduits 346, 343, 344, 347 and one or more valve(s) or solenoid valves) 33, 35, that may be 3-way type valves. Thus, the ink transfer pump 31 pumps ink from the cartridge 30, and the ink passes in sequence through valves 35 and 33 (in positions « 12 » and « 23 » respectively in FIG. 3), and through conduits 343, 344, 347 to reach the main reservoir 10 (path I, identified by the arrow I in FIG. 3). FIG. 3 also shows the "normally open" (NO) and "normally closed" (NC) positions of each valve; for example, the NO and NC states of the valve 35 correspond to positions « 23 » and « 12 » respectively creating connections between conduits 345 and 343, and between 346 and 343 respectively.

It can also be seen that a pump 20 (called the ink pressurisation pump) at the outlet from the main reservoir, pumps ink that can be directed either towards the main reservoir itself (through the return conduit 318) or towards the cartridge 30 itself (and into this cartridge) through conduits 319, 320, The ink path at the outlet from the pump 20 may be controlled by means of one or several valves 37, preferably a 3-way valve. In FIG. 3, the position « 21 » (« NC » ) of valve 37 directs the ink flow towards the conduit 319, and position « 23 » (« NO » ) directs the ink flow towards the conduit 318. Ink is transferred to the print head 1 through a conduit 21 that collects ink downstream from the pump 20, from a point located between the outlet from the pump 20 and the valve 37. The print head itself contains a valve that may or may not authorise production of an ink jet, and possibly printing.

Therefore one or several conduits 319, 320 can be provided to send ink from the main reservoir 10 as far as the cartridge 30. On return, this ink may be recovered; as explained above, it is pumped by the ink transfer pump 31 from the cartridge 30 as far as the main reservoir 10, through a different, or an essentially different, path (except for the common part at the inlet of the cartridge 360) from that used by ink from the main reservoir. Possibly, a conduit 348 in combination with a valve 33 (3-way), connects the outlet from the ink transfer pump 31 to the conduit 320. The positions of valves 33, 35 can be varied (in FIG. 3: valve 35 in position « 12 » (NC state), valve 33 in position « 21 » (NC state)) so that the ink transfer pump 31 circulates ink in a loop I formed by conduits 320, 346, 343, 344

Ink directed at a given pressure from the main reservoir 10 to the cartridge 30 can dissolve or destroy any ink residue plugs that may have formed in the conduits 343, 344, 346, 347 followed, due to circulation of ink during the different phases prior to operation of the printer, or in valves 35, 33 or in the cannula 300. The fluid connections can thus be cleaned, for example during printer shutdown phases, when ink in reservoir 10 is not being used for printing.

The instructions to activate pumps and valves are sent and controlled by the control means 3 (also called "controller"). In particular, these instructions will cause circulation of ink under pressure towards the cartridge 30, then pump ink towards the main reservoir 10. Ink recovered in the main reservoir will be used for cleaning without loss of ink.

The control means 3 are made in the form of a processor or microprocessor, or of an electric or electronical circuit, programmed to implement a cleaning method according to the invention. This controller controls the opening and the closing of the valves, as well as the activation of the pumping means, in order to circulate ink and/or solvent as disclosed in this application. It also memorises data, for example ink level measurement data, and may also process these data. The controller is also programmed to manage operations other than cleaning operations, particularly printing operations.

For safety reasons, the controller makes sure that the cartridge is in position before any ink under pressure is transferred to the cartridge 30. The cleaning operations will not take place if no cartridge is in position.

Like the method disclosed in this application, this verification may be made using the controller 3.

Figure 4:
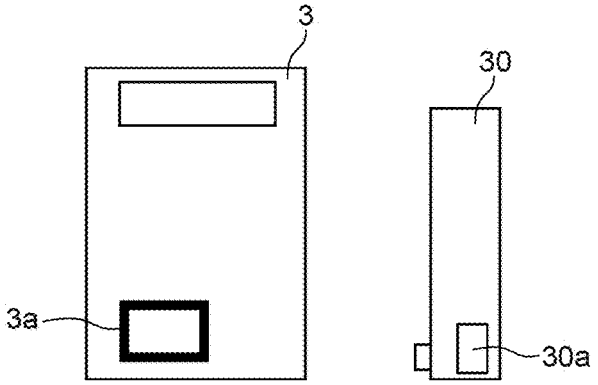
FIG. 4 shows an ink cartridge and means forming the controller of a printing machine.

To achieve this, as shown in FIG. 4, a cartridge 30 may be used in which there is a circuit 30*a* (subsequently called a « tag » ), for example made in the form of a processor or a microprocessor. This circuit 30*a* may for example be applied in contact with a wall of the cartridge 30. It may also comprise communication means, for example an RFID type interface, that can dialogue with the printer controller 3, particularly to provide it with one or more data that will be interpreted as representing the presence of the cartridge.

The controller 3 is also provided with communication means 3*a*, for example an RFID type interface, so that data transmitted by the cartridge tag can be received.

As a variant, communication between the body 3 of the printer and the cartridge 30 may be of the contact type. In this case contacts are provided, firstly on the cartridge, and secondly on the printer, to be sure that data are transmitted between the cartridge 30 and the printer. Presence of the cartridge can be detected by sending an RFID signal from the tag to the controller, or by the controller reading the presence of the tag contacts. This verification may be done periodically.

The controller 3 may also check the non-empty state of the cartridge 30 for example, before starting cleaning operations. The empty state of the cartridge 30 may be detected particularly by variations in the ink level in the main reservoir 10 measured using means 15 and the controller 3. For example, this is the case if the variation of the ink level is less than a threshold value (for example 5/10 mm) for a predetermined duration (for example 20 s), when the pump 31 is in operation to inject ink from the main reservoir 10. On the other hand, if the variation in the ink level during said predetermined duration is more than the threshold value, the cartridge 30 is not empty. If a cartridge is in position but is empty, the cleaning operations will not take place.

The ink transfer from the reservoir 10, to the cartridge 30 is preferably preceded by a step to pressurise the circuit between the reservoir 10 and the cartridge 30, but at an intermediate pressure $P_{ei}$, less than the pressure $P_{e0}$ used during printing, and stabilisation at this intermediate pressure $P_{ei}$ (the pressure $P_{e0}$ would be too high for the cartridge 30).

We could make sure that the ink level in the reservoir 10 remains identical before and after cleaning operations according to the invention, particularly if it is implemented during printer shutdown phases; thus, the user will find the same ink level and therefore the same endurance when printing resumes as when printing operations stopped.

To achieve this, cleaning operations may be:

- preceded by a step in which an ink quantity is transferred through conduits 346, 343, 344, 347, from the cartridge 30 to the reservoir 10, preferably the ink quantity that will be used during cleaning steps;
- and followed by a step in which an ink quantity is transferred from the reservoir 10 to the cartridge 30 through conduits 319, 320, preferably the same ink quantity that was used during the cleaning operations.

Possibly, as explained above, after the step in which an ink quantity is transferred from the cartridge 30 to the reservoir 10 and in order to stabilise the pressure in portions 13of the ink circuit used during cleaning, an ink circulation cycle can be performed in loop I composed of conduits 320, 346, 343, 344.

Before the cleaning steps, the ink level measured in the reservoir 10 may be memorised in the means forming the controller. According to one preferred embodiment, this level measurement (once again using means 15 and the controller) is made after the operations stop, but only after an ink stabilisation period has elapsed, particularly if the ink circuit comprises elements for example such as an anti-pulse device, that may contain a given volume of ink; such a stabilisation step can recover at least part of the ink contained in these elements in the main reservoir 10, preferably once again after stabilisation of the level during a period, for example between 30 s and 2 min.

Another step may be implemented before cleaning as described above, particularly after the printer is shutdown, for example a shutdown lasting for several hours, in order to circulate ink in loop II (see arrow in FIG. 3) composed of the reservoir 10, the pump 20, the valve 37, and the conduit 318; this loop sets up circulation from and to the reservoir 10. This step can eliminate any sedimentation in the reservoir 10 and in the elements of the loop II, and thus prevent any risk of a blockage.

The ink level in the reservoir 10 may be measured again after the cleaning steps, preferably after an ink stabilisation time has elapsed, for example between 30 s and 2 minutes, and if a drop from the level before cleaning is observed, the level may be adjusted by addition of ink from the cartridge 30. We will now describe a particular example embodiment of a cleaning cycle according to the invention.

As explained above, the first step after a shutdown of several hours is to perform a cleaning step of the loops starting from the reservoir 10, to eliminate any sedimentation in these loops, and in the elements of loops that return ink to the reservoir.

The ink pressurisation pump 20 is then stopped and the ink level in the reservoir 10 is allowed to stabilise during a first waiting time $t_1$. The purpose of this operation is to be able to make a good measurement of the ink level so that the same level can be restored at the end of the cycle. It can be considered that the ink level has stabilised when it no longer rises during a period t. This measured ink level $N_0$ is then memorised ($N_0$ is the $1^{st}$ memorised level).

The presence of a non-empty cartridge is then verified, as explained above. If this presence is confirmed, the ink circuit is pressurised so that ink can return to the cartridge 30.

The ink pressurisation pump 20 is restarted, increasing the speed gradually as long as the pressure is less than a value $P_{ei}$ for example between 100 mbars and 1 bar, or the speed of the pump 20 is less than a fraction of the maximum speed, and is reduced if it exceeds $P_{ei}$. Thus, a pressure can be generated so that ink can be drained from the reservoir 10 to the cartridge 30. This step takes just as long as is necessary to achieve a stable pressure and a sufficient flow in the conduits and a stable ink level. A $2^{nd}$ value $N_1$ of the level of the reservoir 10 (at pressure $P_{ei}$) is then measured and memorised.

Ink is then transferred from the cartridge 30 to the reservoir 10, as explained above.

The ink transfer pump 31 and the solenoid valve 35 (in position « 12 » (NC state)) are activated until the ink level in the reservoir 10 rises for example between 1 mm and 5 mm, or until a duration $t_3$ for example between 10 s and 1 minute has elapsed. This step transfers ink from the cartridge 30 to the reservoir 10. At the end of this transfer, the ink level is measured at $N_1$+h. The chosen variation h of the ink level, or the chosen duration, will be such that the ink quantity transferred from the cartridge 30 to the reservoir 10 is larger than the volume contained in the transfer circuit. It is thus assured that ink has actually been transferred from the cartridge 30 and therefore that the cannula 300 has actually been « cleaned » by ink circulation, rather than a simple ink transfer from the circuit which would correspond to simply draining the circuit.

The ink transfer from the cartridge 30 to the reservoir 10 is stopped and circulation is set up in loop I: therefore valves 33, 35 and the ink transfer pump 31 are controlled to make ink circulate in the pump 31 and in the solenoid valves 35 and 33. This step activates the channel 348.

The drain solenoid valve 37 is then closed (from position « 23 » (NO state) to position « 21 » (NC state)), to transfer ink from the reservoir 10 to the cartridge 30, until the ink level in the reservoir 10 returns to the $2^{nd}$ memorised level $N_1$ or until a duration $t_4$ has elapsed. Any plugs can then be eliminated or dissolved and/or a preventive action can be taken to prevent sedimentation.

The drain solenoid valve 37 is then opened (by changing from position « 21 » (NC) to position « 23 » (NO)), and the pressurisation pump 20 is stopped. The ink level is allowed to stabilise, so that the ink level can then be raised to restore it to its initial value. When the level has stabilised, it is checked that it no longer increases over a period for example between 5 s and 20 s.

The ink level in the reservoir 10, is restored to the initially memorised value $N_0$ ($1^{st}$ memorised level, see above). The solenoid valve 33 may be opened (change from the « NC » state (« 21 ») to the « NO » state (« 23 »)), for example periodically, to transfer ink from the cartridge 30 to the reservoir 10 (the pump 31 and the solenoid valve 35 are still active). This operation is repeated until the ink level returns to its initial level.

Figure 5A:
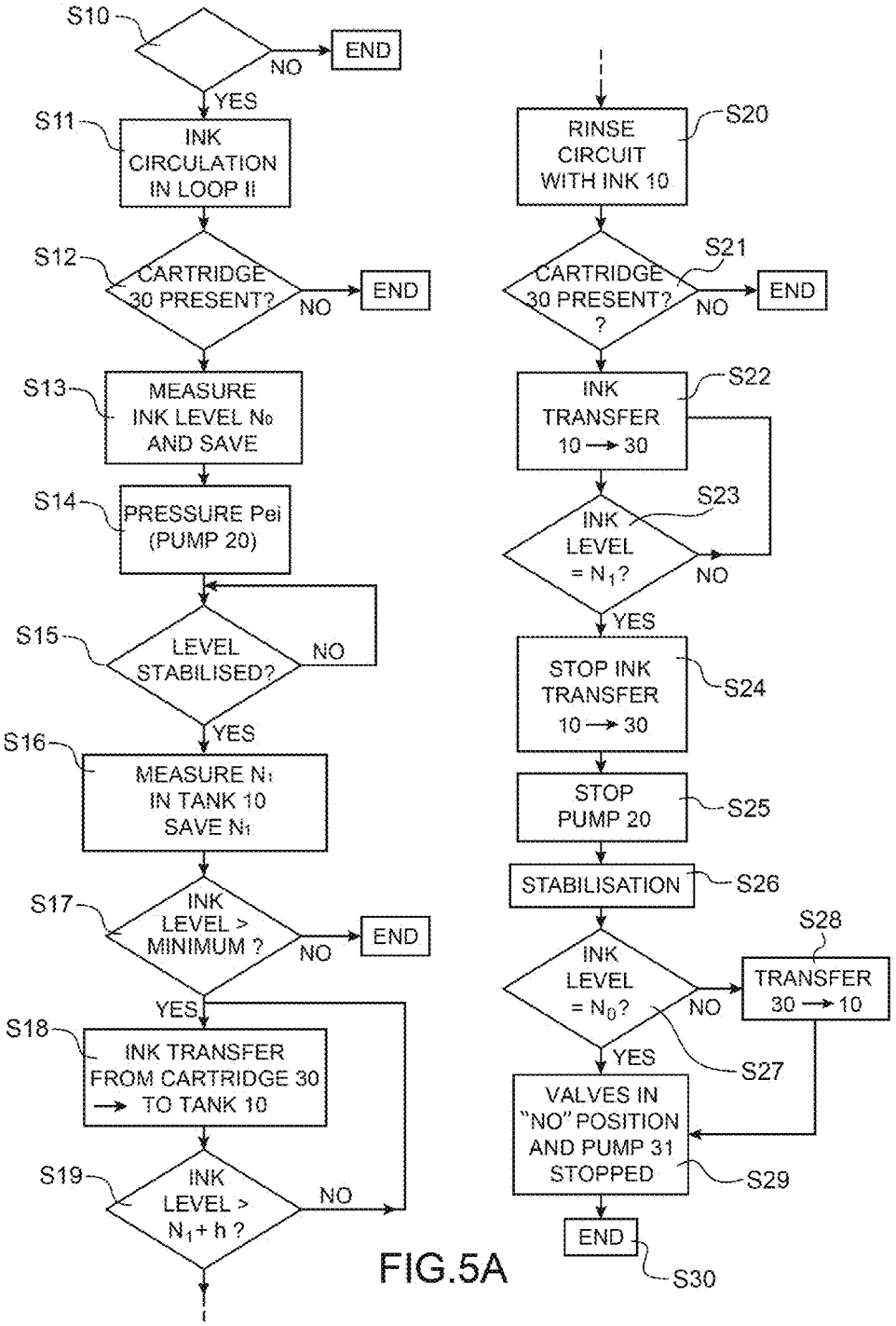
FIGS. 5A and 5B show steps in implementing different cleaning methods using ink, according to this invention.

Finally, the ink transfer pump 31 is stopped and the ink rinsing solenoid valve 33 is then closed. (It changes from the « NO » state (« 23 ») to the « NC » state (« 12 »)), The procedure for a cleaning cycle like that described above is shown in FIG. 5A.

In a first step (S10), the presence of ink in the reservoir 10 is checked. The procedure is stopped if there is no ink.

If ink presence is confirmed, an ink circulation step is performed in the loop II (S11), as described above.

It is then checked that there is an ink cartridge 30 present (step S12). This procedure also has already been explained. The procedure is stopped if there is no ink cartridge.

The ink level in the reservoir 10 is measured and its value $N_0$ is memorised (S13).

The pump 20 is started (S14) so as to reach an intermediate pressure $P_{ei}$, less than the pressure $P_{e0}$ used during printing. The pump 20 is then stopped.

The ink level in the reservoir is stabilised (S15),

Then, the ink level $N_1$ in the reservoir 10 is measured (S16) and memorised.

It is then checked (S17) if the ink level in the reservoir 10 is more than a minimum level. If there is not enough ink, the procedure is stopped. Otherwise, ink is transferred from the cartridge 30 to the reservoir 10 (S18).

The ink transfer continues as long as the ink level is not higher than level $N_1$ (S19) by a quantity h.

The ink circuit is then rinsed with ink from the main reservoir (S20). The ink is then transferred particularly to conduits 319 and 320.

There may also be an intermediate check on the presence of the cartridge 30 (S21). The procedure is stopped if the cartridge is missing.

Some of the ink in the reservoir 10 is then returned to the cartridge 30 (S22): the transfer continues until the level reaches level $N_1$ again (S23).

This ink circulation from the reservoir 10 to the cartridge 30 is interrupted when the valve 37 changes to the « NO » position, and pump 20 stops (S24).

The pump 20 is stopped (S25).

The ink level in the reservoir 10 is then stabilised (S26).

Finally, the ink level in the reservoir 10 can be measured and compared (S27), and adjusted if it has not reached the level $N_0$, by an ink transfer from the cartridge 30 to the reservoir 10 (S28).

The solenoid valves are then changed to the « NO » position, and the pump 31 is stopped (S29).

The procedure is then terminated (S30).

From the above description, it will be understood that detection of the presence of the cartridge 30 in the « non-empty » state and the cleaning steps following this detection are triggered by the machine itself without action by the operator and without the machine being stopped. The operations described above preferably take place after printing operations have stopped. But independently of these printing operations, a cleaning cycle by ink circulation in loop I (conduits 320-343, 344, 348) using the ink transfer pump 31, may be done during printing operations; ink and/or solvent may already be present in this loop I, which facilitates cleaning of this loop. This cycle is performed as described above.

Thus, cleaning of the circuit can continue during printing operations.

This cycle may be preceded by a check on whether or not an ink cartridge 30 is present.

It may be repeated periodically, for example after a given number of hours of operation of the machine in printing.

Figure 5B:
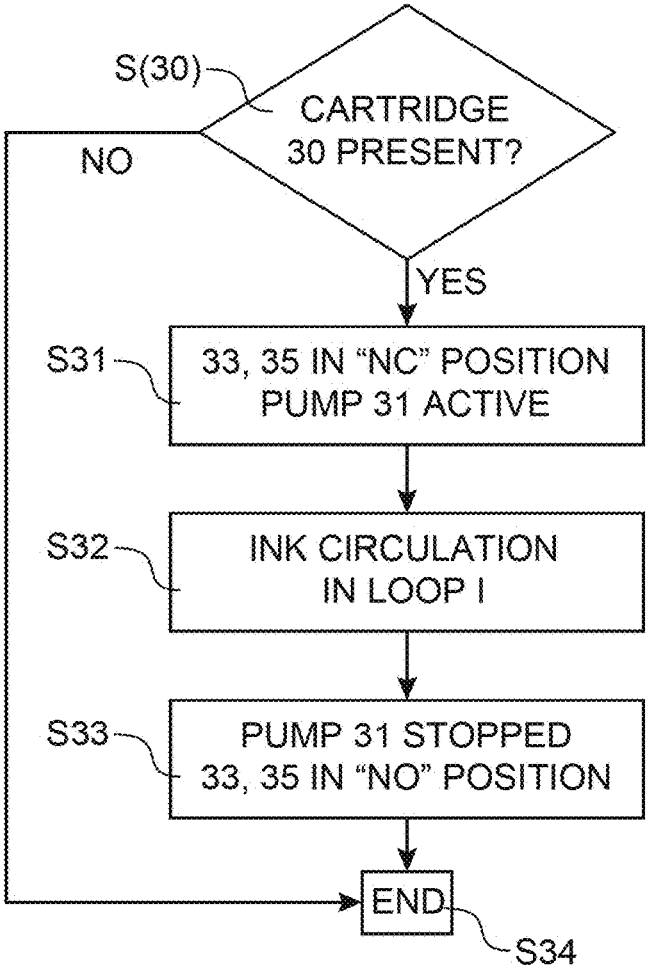

The procedure for this cycle is shown in FIG. 5B.

In a first step (S30), it is checked that an ink cartridge 30 is present. The procedure is stopped if there is no ink cartridge, (S34).

If there is an ink cartridge present, the solenoid valves 35 and 33 are put into the « NC » position, so as to form a circulation loop I. The pump 31 is activated (S31).

Ink then circulates in the loop I (step S32).

The solenoid valves 35 and 33 are then changed (to the « NO » position), and the pump 31 is stopped (S33).

The procedure is then terminated (S34).

As with the previous procedures, at least one intermediate verification that there is an ink cartridge 30 present can be made during this procedure, for example a periodic verification at a time interval $\Delta T_1$ defined by the user.

For safety reasons, the controller can check that the cartridge 30 is still in place and that it is not empty, before this cleaning cycle. These operations have been described above. If there is no cartridge in place or if the cartridge is empty, the cleaning operations will not take place.

As shown in FIG. 3, means 39, 345 can be used to add pressurised solvent, for example at a pressure between 1 and 10 bars, or between 1 bar and 5 bars, into the fluid connection means through the valve 35 (when it is in position « 32 » (NO) in FIG. 3). The solvent originates from a removable solvent cartridge 40 or an intermediate reservoir 14 (see explanations below about this intermediate reservoir). The means 345 are shown diagrammatically, examples of these means will be described later. According to the embodiment illustrated, these means comprise at least one conduit 345 located upstream from the valve 35. This solvent may be directed through the conduits 343, 344 depending on the open or closed state of the valves 35 and 33:

- to reservoir 10 (through the conduit 347, valve 35 in position « 32 » (NO), valve 33 in position « 23 » (NO)), to add solvent into the reservoir 10;
- to conduits 320 (through the conduit 348, valve 35 in position « 32 » (NO), valve 33 in position « 21 » (NC)), then along path I. Since the valve 37 is in the NO position, solvent is directed to the cartridge 30 through conduits 344, 348 and 320.

A pressure sensor 47 can be placed on the solvent path, upstream from the valve 35 in the diagram in FIG. 3.

The device can also comprise an intermediate reservoir 14 that can be provided with level measurement means 14', and that can be filled from the cartridge 40. This reservoir 14 can send solvent to the circuits or to the print head to clean them; it also supplies solvent to the main reservoir.

Circulation of pressurised solvent can dissolve or destroy plugs of ink residue that may be formed in the conduits 320, 343, 344, 345, 346, 347 and possibly 348, followed by ink during the different operating phases of the printer, or in the valve(s) 35, 33 or in the cannula 300. Fluid connections can thus be cleaned, and it is particularly useful to apply this cleaning operation after the cartridge 30 has been emptied and before it has been removed for replacement by a full cartridge.

The solvent may originate from the removable solvent cartridge 40 or from the reservoir 14, through a pump (not shown in FIG. 3), dedicated to pumping solvent and that pressurises the solvent.

After being directed to the cartridge 30, the solvent can then be pumped to the main reservoir 10. The solvent path is then the path normally followed by ink (FIG. 3, path through conduits 343, 344, 347), from the cartridge 30 to the main reservoir 10: after cleaning, the valve 35 changes from the NO state (« 32 » ) to the NC state (channel « » 12 » ) and the pump 31 is activated to transfer cleaning solvent to the reservoir 10 (the valve 33 being in the « NO » position). Therefore solvent can be used to clean the conduits in which it is circulating, and the cannula 300; it can then be kept in the circuit, without being lost.

Such a cycle (transfer of solvent, recovery in the main reservoir 10), may be reiterated.

Preferably, cleaning by solvent takes place when the cartridge 30 is present but empty, which can be detected by variations in the measured level in the main reservoir 10, as described above.

One example of a cleaning sequence using the method described above, could be as follows:

a) $1^{st}$ rinsing of conduits 343, 344, 348, valves 35, 33 and the cannula 300 by pressurised solvent, then recovery of solvent in the reservoir 10;

b) $2^{nd}$ rinsing of these conduits and the cannula 300 by pressurised solvent, then recovery of solvent in the reservoir 10;

c) final rinsing of these conduits and the cannula 300 by pressurised solvent, without recovery of solvent in the reservoir 10; the fact that the solvent is kept during this step can avoid any subsequent blockage by keeping solvent in the cartridge, which prevents drying.

The « empty » state of the cartridge 30 is detected before the cleaning operations described above making use of ink level measurements, for example level measurements made in the main reservoir 10 using means 15, and the controller. The controller also makes the decision and sends instructions to circulate pressurised solvent to the cartridge 30, and then to pump it towards the main reservoir 10.

For safety reasons, it can be checked that the cartridge is still in place before starting to transfer pressurised solvent to the cartridge 30. This verification has been explained above. As for the cleaning process, it can also be done using the controller.

After the cleaning phases have been completed, the cartridge 30 can be replaced by a full cartridge.

It can be easily understood from the above description that detection of the « empty » state of the cartridge 30 and the cleaning steps that follow this detection, are triggered by the machine itself, without action by an operator, and without the machine being stopped. The machine can continue to print simultaneously.

Another application of the invention applies to the case in which the cartridge 30 is not empty and a blockage is detected along the ink path from the cartridge 30 to the main reservoir 10.

A blockage in one of the ink circulation conduits or in the cannula 300 can be detected from solvent pressure or level measurements. This diagnostic can be made by the controller that processes pressure measurements, estimates the variation of the ink level in the reservoir for a given duration and pumping power and compares it with what is normally expected under these duration and pumping power conditions.

According to one embodiment, when it is required to draw off ink either when the printer is switched on or when it is in operation, it is checked if there is a blockage in the connections. The following tests may be done for this purpose, for example by the controller:

- measure the pressure variation when the circuit is opened (for example by changing the position of valves 35 and 33 in FIG. 3); if there is no variation, it is concluded that there is a blockage;
- and/or measure the solvent level when the circuit is opened (for example by changing the position of valves 35 and 33 in FIG. 3); if there is no variation, it is concluded that there is a blockage.

As described above, solvent under can then be injected under pressure Ps=P1, for example between 1 and 10 bars, towards the cartridge 30. The pressure Ps can be detected by the sensor 47. This injection can be done periodically.

If there is no blockage or if solvent eliminates an obstacle along the path followed by the solvent, the solvent pressure Ps reduces to a value P2<P1. The solvent can then be reinjected into the main reservoir 10, as was explained above.

On the other hand, if the solvent pressure Ps remains stable, the controller still produces a diagnostic of a blockage situation. The pressure P1 is then held for a given duration Δt1, for example a few seconds, to eliminate the obstacle. This may be combined with one or several pressure pulses or sudden variations, for example by open and close cycles of solenoid valve 35, to reach a pressure P3>P1, each of these « pulses » being generated for example for a short period, with duration Δt2<Δt1. If the pressure Ps reduces after this step to value P2<P1, then the obstacle must have been eliminated and solvent can be reinjected into the main reservoir 10, as described above. If the pressure Ps still does not reduce, for example after a given duration that could be of the order of a few tens of seconds, one solution is to perform a manual action and/or to replace the cannula 300 or the ink module itself (that contains some of the fluid connections between the cartridge 30 and the main reservoir).

In all cases, the pressurised solvent transferred to the cartridge 30 can then be pumped to the main reservoir 10. The circuit is then the circuit normally followed by ink from the cartridge to the main reservoir; after cleaning, the set of valves 33-35 is reconfigured to send cleaning solvent to the main reservoir 10. Therefore the solvent cleans the conduits in which it will circulate and the cannula 300, and is then kept in the circuit without being lost.

As mentioned above, a blocking situation in one of the conduits or the cannula can be detected using the machine controller. This controller will:

- make the decision to circulate pressurised solvent towards the cartridge 30, and issue the corresponding instruction;
- process information from sensor 47, so that it can pump solvent towards the main reservoir 10, or maintain the solvent pressure in the conduits considered to be blocked.

Figure 6:
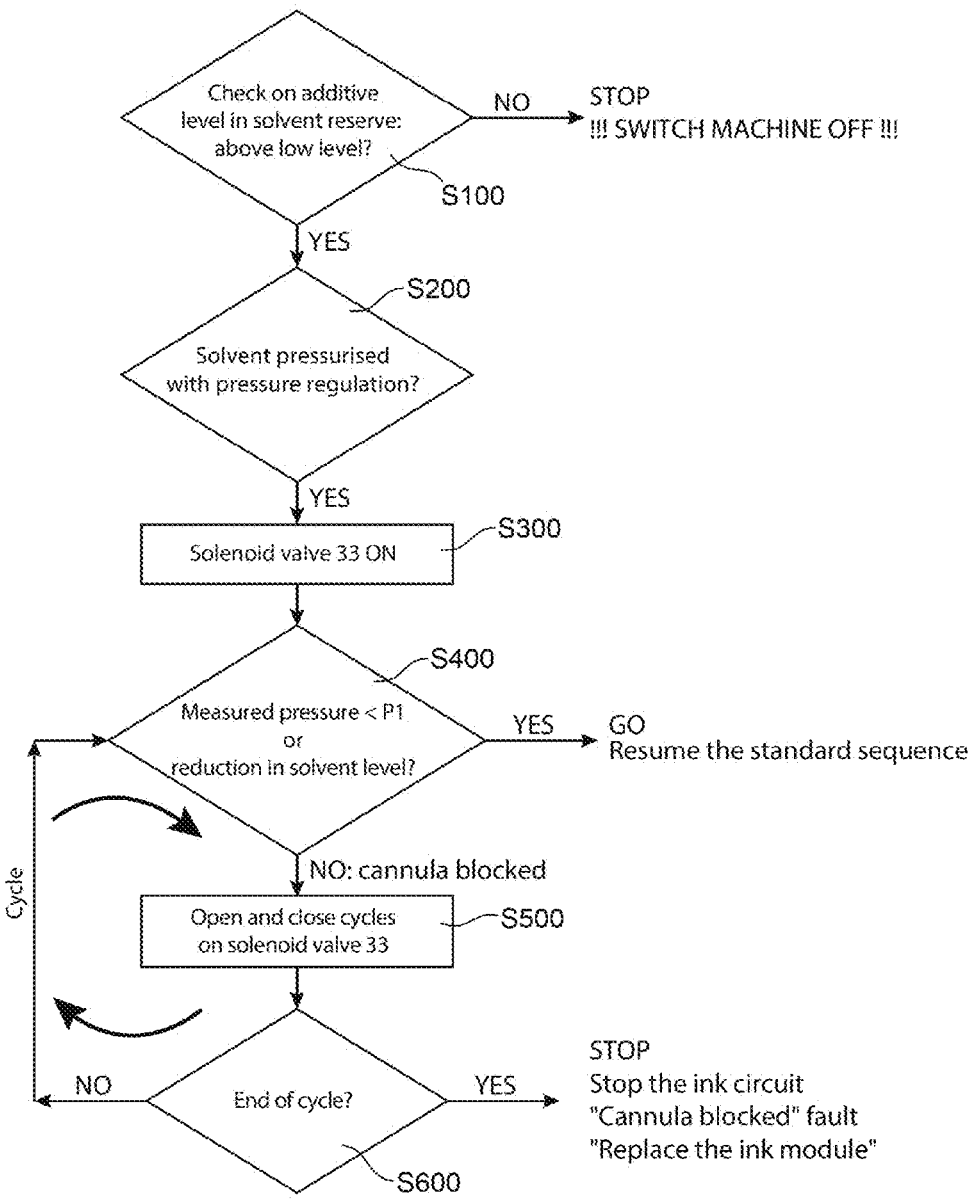
FIG. 6 shows steps in implementing a cleaning method using solvent, according to this invention.

As explained above for the case of a cartridge, for safety reasons it can be checked that the cartridge 30 is still in place before pressurised solvent is transferred to the cartridge. The means used for this purpose can be the means described above (tag 30*a* and controller). It can be checked in advance whether or not the solvent level is sufficient or if it is greater than a lower limiting value. As described above, this step can also be performed when cleaning is done after it has been detected that the cartridge is in the empty state, An example embodiment of this method is shown in FIG. 6.

In a first step (S100), the solvent level in the intermediate reservoir 14 is checked.

If this level is less than a value at a predetermined threshold, then the printer is stopped immediately so that it will not operate without solvent. This step may also be performed in the case of cleaning after it is detected that the cartridge is in the empty state.

If it is greater than this threshold value, the solvent may be pressurised (step S200), for example to a pressure P1 between 1 bar and 10 bars, or between 1 bar and 5 bars. If this pressure cannot be reached, then a defect is detected. If this pressure can be achieved, the solvent is transferred (step S300) towards the ink cartridge 30 as described above, by opening valve 33. More specifically, valve 35 remains in position « 32 » (« NO »), solvent passes through valve 33 (in position « 21 », NC), and opening cycles are then implemented on valve 33 to generate pressure pulses.

The next step (step S400) is to perform a test on whether the solvent pressure is maintained or reduced during a given duration Δt1. For example, it can be tested if the pressure at the end of this duration has reduced by a predetermined value, for example between 1%×P1 and 50%×P1 or if the solvent level or volume has reduced by a predetermined value Δh1 or ΔV1 (for example by measuring solvent in the reservoir 14); if the answer to either of these questions is positive, then it is considered that the circuit is unblocked and the standard operating sequence of the machine can be resumed.

Otherwise, it is considered that the ink circuit is blocked; in this case, the pressure can be temporarily increased (step S500), for example by pressure pulses (or pressure variations) (as described above) that can be generated by one or several open and close cycles of valve 33.

A test can also be performed on the duration of cleaning or unblocking operations (step S600); if the cycle duration is longer than a predetermined duration Δt, it may be decided to stop cleaning and for example to replace the ink module.

Otherwise, the test in the previous step S400 can be repeated until the predetermined duration has been reached.

All the operations described above can be implemented by the machine controller, programmed for this purpose.

In other words, the diagnostic concerning a blockage situation and the remedy provided for it can be formulated and triggered by the machine itself, without any action by an operator, and without the machine being stopped. The machine can continue to print at the same time.

Figure 7:
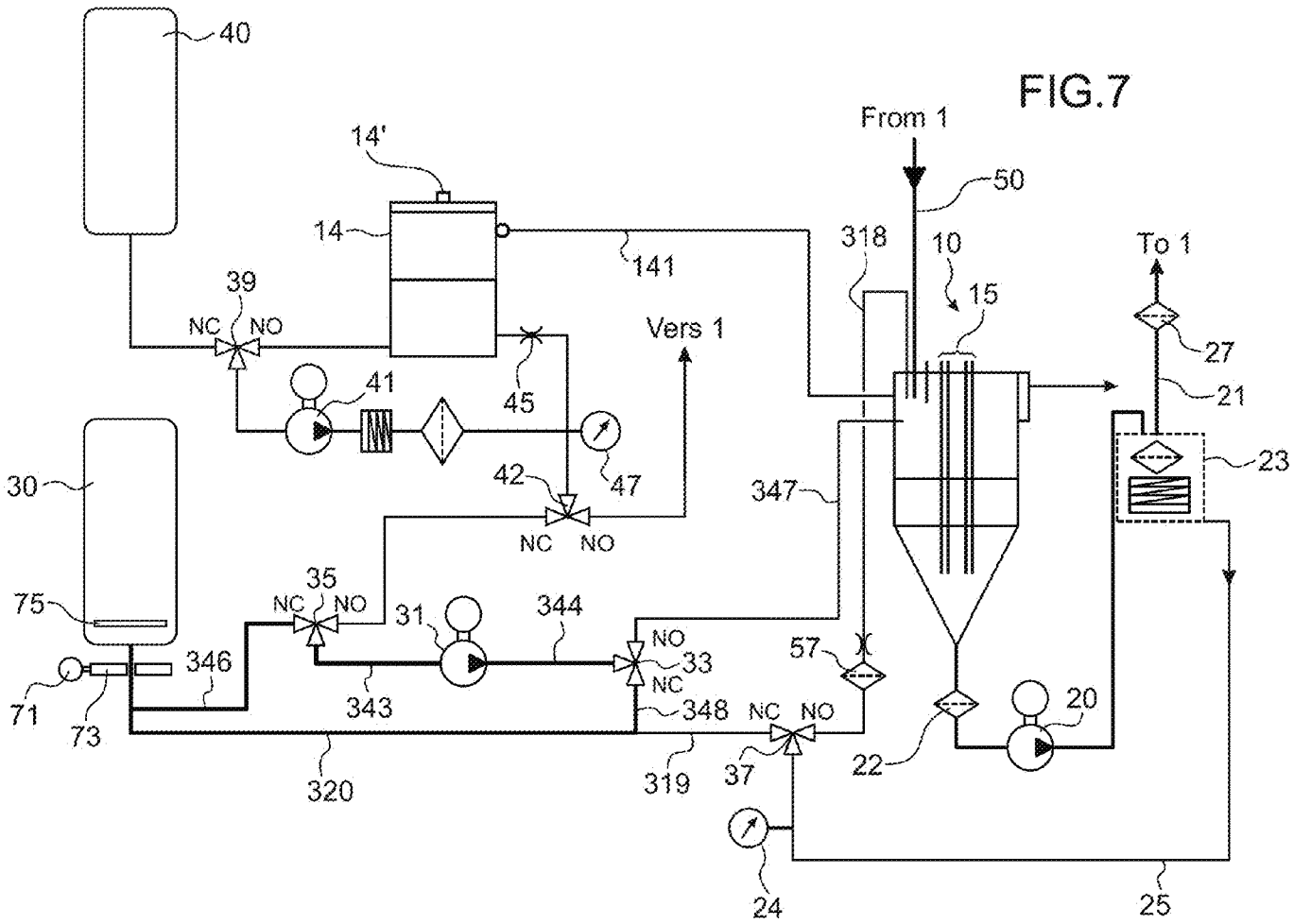
FIG. 7 shows another example of a fluid circuit structure using a circuit using a circuit according to this invention.

FIG. 7 shows an in ink circuit in which the circuit and the method described above, particularly with reference to FIG. 3, 5A, 5B or 6, can be used.

In this figure, numeric references identical to those in the previous figures refer to identical or corresponding elements.

At the outlet from the main reservoir 10, there is a filter 22, and then the pump 20 and an anti-pulse device 23. As described above, ink is transferred to the print head 1 through the conduit 21 connected on the downstream side of the anti-pulse device 23, between the pump 20 and the valve 37. The print head itself contains a valve that enables or disables production of an ink jet and possibly printing.

Ink is filtered by the main filter 27 before being sent to the head 1.

A pressure and possibly temperature sensor 24 may be provided as shown in the figure; data output by this sensor are used by the controller to slave the ink pressure to a set value, usually when the velocity of the ink jet in the head is not available (for example when ejection of the jet is stopped, or when the jet velocity cannot be measured).

Moreover, the intermediate reservoir 14 forms a storage reservoir inside which solvent is stored. This reservoir is intermediate between the solvent cartridge 40 (removable) and the reservoir 10. Solvent can be sent from the cartridge 40 to this reservoir 14 as described below. A conduit 141 can be used to bring the free volume located above each of the liquids contained in the reservoirs 10 and 14 to the same atmospheric pressure.

A solvent transfer pump 41 transfers solvent towards the ink circuit, as described above. This solvent passes through a 3-way valve 42, which can therefore direct it either to the ink circuit (« NC » position of valve 42), or to the print head 1 (« NO » position of valve 42).

A restriction 45 at the inlet to the reservoir 14 enables filing of the reservoir and participates in pressure generation. The reservoir 14 can be filled as follows: the valve 39 is in the « NC » position (see FIG. 6), so that solvent can be pumped using pump 41, from the cartridge 40. The valve 42 is in the closed (NC) position while valve 35 is in the NC position, which blocks circulation of solvent towards the cartridge 30 and also towards the conduit 343; therefore, solvent is directed towards the restriction 45 and enters the intermediate reservoir 14.

Finally, the reference 50 refers to a conduit through which ink and/or solvent from the print head gutter or from the head rinsing circuit can be transferred to the main reservoir 10.

The level measurement can be used to estimate whether or not a cartridge 30 is empty, as described above.

The invention is particularly useful for ink containing dense particle dispersions such as metals or metal oxide pigments, for example titanium, zinc, chromium, cobalt or Iron (such as $TiO_2$, ZnO, $Fe_2O_3$, $Fe_3O_4$, etc.) in the form of micronic or sub-micronic particles. Such a pigment ink can for example be based on $TiO_2$, and can be used for marking and identification of black or dark supports.

But it is also useful in the case of a non-pigment ink that can dry and form deposits of dry material in the conduits and connections of the ink circuit, as described above, In the embodiments disclosed, a system can be provided for mixing ink from the cartridge, comprising:

motor 71;

a magnet support 73.

A fastening screw can be used to fix the magnet support 73 onto the motor 71.

A magnetised bar 75 is inserted inside the ink cartridge 30. Interaction of these elements can rotate the magnet 75 inside the ink and thus stir ink in the cartridge.

The invention claimed is:

1. Method of cleaning an ink circuit of an inkjet printer, comprising at least:

a reservoir, called the main reservoir, an ink cartridge, a first pump to pump ink from the cartridge, a first fluid connection to transfer ink from the ink cartridge to the reservoir, a second pump to pump ink from said reservoir, a second fluid connection to transfer ink from the reservoir to the ink cartridge, and a printer controller, this method comprising at least:

a) a step in which ink is transferred from the main reservoir into the cartridge, through the second pump and the second fluid connection, b) a step to pump at least part of the ink transferred during step a) back into the main reservoir, through the first pump, and the first fluid connection, along a path different from the path used by ink from the main reservoir, except for a common part at the inlet to the cartridge.

2. Method according to claim 1, in which the ink level in the main reservoir remains identical before step a) and after step b).

3. Method according to claim 2, comprising at least detection of the ink level in the main reservoir, at least before step a) or after step b).

4. Method according to claim 3, comprising a step to stabilize the ink level in the reservoir each time before detection of the ink level in the reservoir.

5. Method according to claim 3, comprising:

a comparison between levels measured before step a) and/or after step b), addition of ink into the main reservoir if the ink level after step b) is lower than the level before step a).

6. Method according to claim 1, comprising:

before step a), a step in which an ink quantity, preferably the ink quantity that will be used during steps a) and b) is transferred from the cartridge to the reservoir, through the first pump and the first fluid connection;

after step b), a step in which an ink quantity is transferred from the reservoir to the cartridge through the second pump and the second fluid connection.

7. Method according to claim 1, the ink circuit comprising a third fluid connection between the first fluid connection for transferring ink from the ink cartridge to the reservoir, and the second fluid connection to transfer ink from the reservoir to the ink cartridge, the method comprising a step for circulating ink using the first pump, through part of the first fluid connection, the third fluid connection, and part of the second fluid connection.

8. Method according to claim 1, step b) being preceded by a step to pressurise at least part of the circuit between the reservoir and the cartridge, to an intermediate pressure ($P_{ei}$), less than the pressure ($P_{e0}$) used during printing, and stabilisation at this intermediate pressure ($P_{ei}$).

9. Method according to claim 1, also comprising, in particular when the ink cartridge is empty, the following steps, at least one or several times:

a') a step in which solvent is transferred to the ink cartridge at pressure P1, through at least part of the first fluid connection, b') a step in which at least part of the solvent transferred to the main reservoir during step a') is pumped, said step b') being possibly performed using said first pump to pump ink from said ink cartridge to the main reservoir.

10. Method according to claim 9 in which, after step a'), the solvent is kept under pressure P1, while making one or several measurement of the variation in the solvent pressure or the level or volume of the solvent, and the solvent pressure may be varied one or several times if a reduction in the solvent pressure or the level or volume of the solvent greater than a threshold value is not measured.

11. Method according to claim 1, comprising a step to detect the presence of the ink cartridge, for example by exchanging at least one item of data between a circuit associated with the cartridge and the printer controller.

12. Method according to claim 1, comprising a step, to detect the empty state, or non-empty state, of the ink cartridge, for example making use of at least one measurement of an ink level in the main reservoir.

13. Method according to claim 1, comprising a step, to detect the clogged state of at least part of the fluid connection between the ink cartridge and the reservoir.

14. Method according to claim 13, in which the clogged state of at least part of the fluid connection is detected by measuring the variation of the ink level in the main reservoir, when pumping ink from the ink cartridge to the main reservoir or following pumping.

15. Method according to claim 13 in which, after detection of the clogged state, solvent is transferred to the ink cartridge at pressure P1, through at least part of the first fluid connection, is kept under pressure P1, while making one or several measurement of the variation in the solvent pressure or the level or volume of the solvent, and the solvent pressure may be varied one or several times if a reduction in the solvent pressure or the level or volume of the solvent greater than a threshold value is not measured.

16. Ink circuit of a continuous inkjet printer, comprising at least one reservoir, called the main reservoir, and a printer controller, said controller being programmed to implement a method according to claim 1.

17. Ink circuit of a continuous inkjet printer, comprising:

a reservoir, called the main reservoir;

a first pump to pump ink from a cartridge, first fluid connection to transfer ink from an ink cartridge to the reservoir, a second pump to pump ink from said reservoir, a second fluid connection to transfer ink from the reservoir to an ink cartridge, and a printer controller, which controller is being designed to:

a) transfer ink from the main reservoir into a cartridge, through the second pump and the second fluid connection, b) pump at least some of the ink transferred in step a) back into the main reservoir, through the first pump, and through the first fluid connection, along a path different from the path followed by ink transferred from the main reservoir to the cartridge, except for a common part at the inlet to the cartridge.

18. Ink circuit according to claim 17, said fluid connection being connected to a solvent circuit to inject a solvent into the ink circuit.

19. Ink circuit according to claim 17, comprising at least one of:

a sensor to measure an ink level in the main reservoir, said printer controller being capable of calculating a residual ink level in an ink cartridge connected to the fluid connection;

a sensor to measure the ink pressure in the ink circuit.

20. Continuous inkjet printer, comprising:

an ink circuit according to claim 17, a print head, a hydraulic connection to bring ink to be printed to the print head from the ink reservoir and to transfer ink to be recovered from the print head to said ink circuit, electrical connection means to electrically power said print head.

* * * * *